US005675792A

United States Patent [19]

Earle et al.

[11] Patent Number: 5,675,792

[45] Date of Patent: Oct. 7, 1997

[54] CARTRIDGE WITH SUPPLY ARRANGEMENT AND METHOD FOR USING THE CARTRIDGE AND SUPPLY ARRANGEMENT

[75] Inventors: Anthony Earle, Harrow Weald; John Richard Fyson, Hackney, both of United Kingdom; Edward Charles T.S. Glover, Harrow, England

[73] Assignee: Eastman Kodak Company, Rochester, N.Y.

[21] Appl. No.: 601,277

[22] Filed: Feb. 14, 1996

[30] Foreign Application Priority Data

Feb. 16, 1995 [GB] United Kingdom ..... 9503068

[51] Int. Cl.[6] ..... G03D 3/08

[52] U.S. Cl. ..... 396/626; 396/641; 222/318; 222/424

[58] Field of Search ..... 354/322, 324, 354/331, 336, 323; 222/82–86, 129, 318, 251, 424; 396/626, 641, 587, 954, 923, 942

[56] References Cited

U.S. PATENT DOCUMENTS

| | | | |
|---|---|---|---|
| 3,687,050 | 8/1972 | Wilke | 396/626 |
| 4,518,240 | 5/1985 | Taylor et al. | 396/324 X |
| 4,814,809 | 3/1989 | De Prijcker et al. | 396/626 |
| 5,148,208 | 9/1992 | Klosterboer et al. | 354/324 |

FOREIGN PATENT DOCUMENTS

| | | |
|---|---|---|
| 0 227 358 | 7/1987 | European Pat. Off. . |
| 1 434 914 | 5/1976 | United Kingdom . |
| 81/01241 | 5/1981 | WIPO . |

*Primary Examiner*—D. Rutledge
*Attorney, Agent, or Firm*—Frank Pincelli

[57] ABSTRACT

A cartridge for receiving a photographic processing chemical comprises a main body formed with an outlet by way of which the chemical may be introduced into or removed from the cartridge. The main body also has a connection for a venting arrangement which provides communication between the interior of the main body of the cartridge and atmosphere when the cartridge is in use. The connection for the venting arrangement is located adjacent, and faces in the same direction as, the outlet in the main body so that in a single "plug-in" operation the cartridge can be located upon a processing apparatus to establish connections for the supply and return of the processing chemical and a connection with a venting arrangement provided on the processing apparatus.

9 Claims, 3 Drawing Sheets

CARTRIDGE WITH SUPPLY ARRANGEMENT AND METHOD FOR USING THE CARTRIDGE AND SUPPLY ARRANGEMENT

FIELD OF THE INVENTION

The present invention relates to photographic processing chemicals and more particularly to a cartridge for receiving a photographic processing chemical and to a photographic processing apparatus with which such a cartridge can be used.

BACKGROUND OF THE INVENTION

A photographic processing apparatus comprises a series of tanks which receive various processing solutions through which photographic material is passed as it is processed. The processing solutions consist of chemicals which can sometimes be of a hazardous nature and it is therefore known to supply the solutions in sealed cartridges or containers which can be connected to the photographic processing apparatus with the minimum degree of handling by an operator.

The processing solution or chemical is pumped from the cartridge to a tank in the processing apparatus and, when exhausted, is pumped back into the container to be sealed and removed for safe disposal or recycling. Several cartridges may be provided in a single "plug-in" cassette where connections between the cartridges and respective tanks in the photographic processing apparatus are automatically established when the cassette is located in position with respect to the processing apparatus. Thus, locating the cassette upon the apparatus may automatically establish supply and return line connections between the cartridges and the tanks in the processing apparatus.

Each cartridge may comprise a collapsible container or "bag" formed of a flexible material. However, these bags are generally complex in construction, have a limited life and allow the ingress of a certain amount of air which will act to degrade the chemical solution. In addition, as solution is pumped back into the bag from the processing apparatus there is a danger of the bag bursting if too much liquid is pumped back in and there is not careful monitoring of the transfer of the solution.

A rigid container for the processing solution does not suffer from these disadvantages and can be made of a non-porous material of sufficient strength to provide protection against any build-up of pressure. A rigid container may also be re-used. However, when formed of a non-porous material, a rigid container will experience a build-up of internal pressure as procession solution is pumped back into the container due to the air which becomes entrained in the solution. Whilst there is little danger of the rigid container bursting or rupturing as a result of this increased internal pressure, the pressure places an increased load upon the pump which returns the solution to the container. Similarly when processing solution is being pumped out of a rigid container, a partial vacuum is created within the container, again imposing an increased load on the pump. This necessitates the use of a larger pump having a greater power consumption, thereby making the processing apparatus more expensive to operate.

The build-up of air and increased pressure within the rigid container as processing solution is pumped back into the container can act to prevent the return of all of a spent processing solution to the container, resulting in exhausted solution being left in the processing apparatus. This is particularly undesirable because any contaminated or exhausted solution left in a processing tank will contaminate a fresh supply of solution introduced into that tank.

Furthermore, the increased or decreased pressure within the container will cause the processing solution to continue to flow in one direction or the other, even when the pump which is used to convey the solution has been switched off. This can result in a leakage of the processing solution which, as mentioned above, may be a hazardous chemical.

SUMMARY OF THE INVENTION

Whilst it is known to provide a rigid container with an inlet/outlet connection at one end by way of which a processing solution may be introduced into and removed from the container and a manually operable vent in the form of a tap at the other end, this arrangement is far from ideal. The construction of such an arrangement is relatively complex and therefore expensive. The vent must be operated manually in order to equalize the pressure within the container with the ambient pressure and this type of container is therefore not readily suited for use with an automated processing apparatus designed to receive a cassette containing several cartridges of different solutions which are connected to the apparatus by way of plug-in connections.

The present invention seeks to provide an improved cartridge for a photographic processing chemical which does not suffer from the problems outlined above and a processing apparatus with which the cartridge can be used.

According to one aspect of this invention there is provided a cartridge for receiving a photographic processing chemical, the cartridge comprising a main body formed with an outlet by way of which the chemical may be introduced into or removed from the cartridge and a connection for a venting arrangement to provide communication between the interior of the main body of the cartridge and atmosphere when the cartridge is in use, the connection for the venting arrangement being disposed adjacent and facing in the same direction as the outlet formed in the main body.

Preferably the connection for the venting arrangement and the outlet in the main body each take the form of a projecting neck formed at one end of the main body.

Conveniently the connection for the venting arrangement is formed integrally with the outlet in the main body at one end of the main body.

Advantageously the connection for the venting arrangement and the outlet in the main body are each provided with a closure in the form of a penetrable, self-sealing cover.

Preferably the connection for the venting arrangement and the outlet in the main body are both formed at one end of the main body and are positioned such that when the cartridge is in use the connection for the venting arrangement is disposed uppermost and extends into an upper region of the main body and the outlet is disposed at a lower position.

Conveniently, when the cartridge is in use the outlet is disposed adjacent a lowermost edge of the main body of the cartridge.

According to a second aspect this invention provides a photographic processing apparatus comprising at least one tank for receiving a photographic processing chemical and a supply system for supplying the chemical to the tank from a cartridge as described above, and for returning the chemical to the cartridge, the apparatus additionally comprising a venting arrangement adapted, when in use, to be connected to the interior of the cartridge by way of the connection for the venting arrangement provided in the cartridge.

Preferably the venting arrangement comprises a hollow needle connected to a venting tube, the needle being adapted, when in use, to extend into the interior of the cartridge through a penetrable self-sealing cover provided on the connection for the venting arrangement.

Conveniently the apparatus includes a plurality of tanks for receiving different photographic processing chemicals and a plurality of supply systems, there being a supply system associated with each processing tank and a venting arrangement associated with each supply system, the venting arrangement of each supply system being connected to a respective container of processing chemical when the apparatus is in use.

In a third aspect this invention provides a method of supplying a photographic processing chemical to a photographic processing apparatus as described above, the method comprising the steps of mounting a cartridge of photographic processing chemical of the type described above upon the apparatus and connecting the venting arrangement of the apparatus to the interior of the cartridge by way of the connection for the venting arrangement provided on the cartridge.

BRIEF DESCRIPTION OF THE DRAWINGS

In order that the present invention may be more readily understood and so that further features thereof may be appreciated, the invention will now be described by way of example, with reference to the accompanying drawings in which.

DETAILED DESCRIPTION OF THE PREFERRED EMBODIMENT

Figure 1:
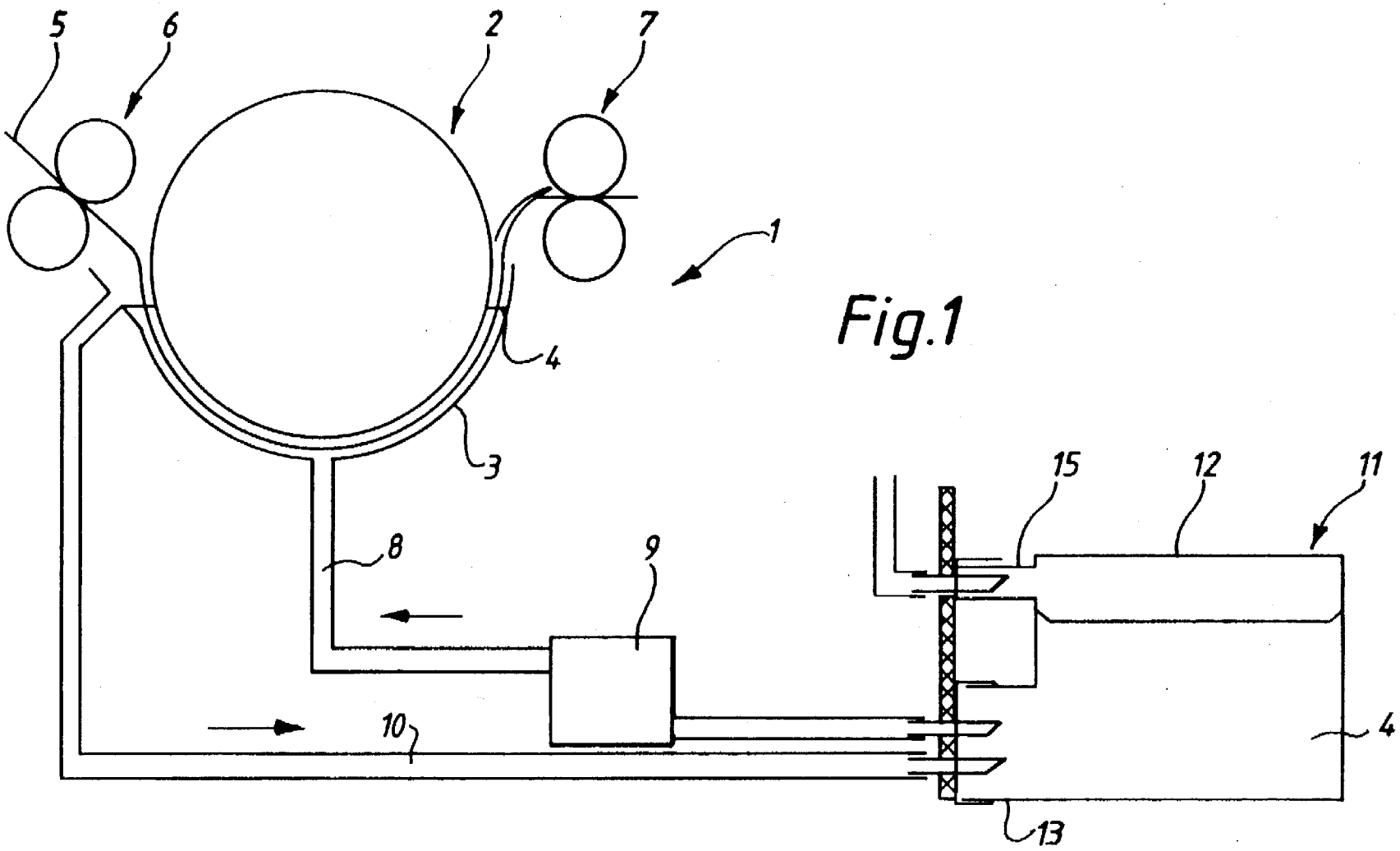
FIG. 1 is a schematic side elevation of a cartridge of processing chemical in accordance with this invention when mounted upon a photographic processing apparatus.

In FIG. 1 of the drawings there is shown a photographic processing apparatus 1 having a processing station 2 incorporating a tank 3 designed to receive a photographic processing solution 4 through which a web of photographic material 5 is conveyed by way of sets of rollers 6, 7 as it is processed.

The tank 3 is connected to a container 11 of the photographic processing solution 4 by way of a supply line 8 incorporating a pump 9 and a return line 10.

It will be appreciated, of course, that the photographic processing apparatus 1 will normally incorporate a plurality of processing stations such as the station 2 illustrated in FIG. 1 with each processing station having a tank to receive a different processing solution, with the tank of each processing station being connected to its own respective container 11 of processing solution. The web of photographic material 5 would, during processing, be conveyed through the various processing stations 2 in a predetermined sequence.

Figure 2:
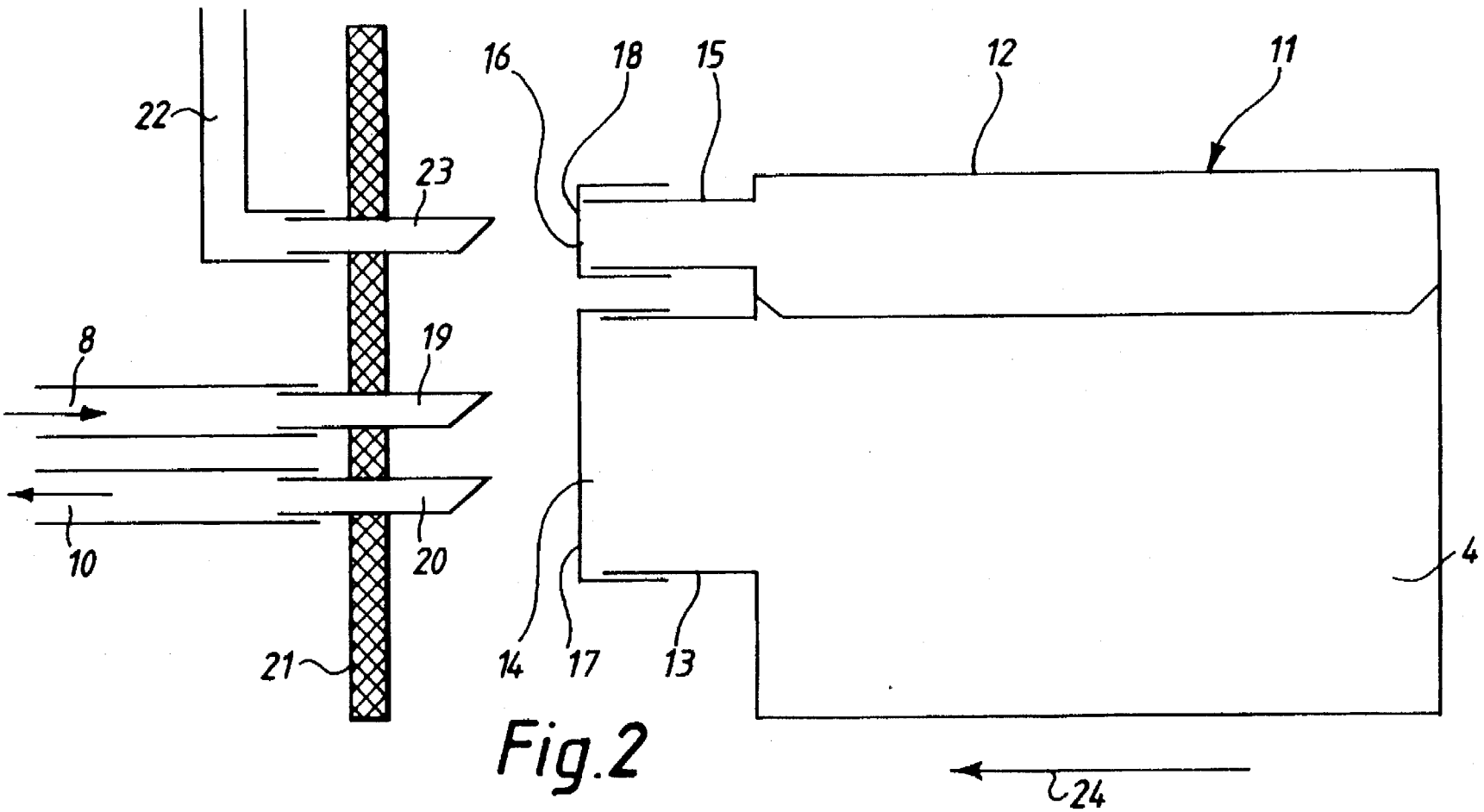
FIG. 2 is an enlarged side elevation of a slightly modified cartridge and part of the processing apparatus when the cartridge has been removed therefore.

The container 11 comprises a main body 12 for receiving the processing solution 4. The main body 12 is formed, at one end, with a projecting neck 13 which defines an outlet opening 14. Whilst in FIG. 1 of the drawings the projecting neck 13 is shown as being disposed adjacent one side of the main body of the container 11, FIG. 2 illustrates a slightly modified arrangement in which the neck 13 is located centrally as one end of the container. At the same end of the main body 12 as is formed with the projecting neck 13, the body has a second projecting neck 15 which extends parallel to the neck 13 and which defines an outlet opening 16 facing in the same direction as the outlet opening 14. The container 11 may comprise a substantially rigid plastics bottle or may comprise a container having a flexible main body 12 provided with substantially rigid projecting necks 13,15.

The outlets 14,16 defined by the necks 13,15 are each closed by way of respective penetrable self-sealing covers or septa 17,18 which extend over the openings so as to form a sealed closure. Each septum 17,18 may be formed of natural or synthetic rubber or of any other elastic material with similar properties and which is penetrable yet self-sealing. A septum of this type is typically used for sealing biological sample bottles. The septa 17,18 are, of course, only illustrated schematically in the accompanying drawings and may take any convenient form which can be fixed over the outlets defined by the container 11 in order to provide a seal.

In use the container 11 is filled with a ready-mixed photographic processing chemical 4 which is to be used the tank 3 of the processing apparatus 1. The outlets defined by the necks 13,15 are then closed by way of the septa 17,18. The container is then supplied, in a sealed condition, ready for use with the photographic processing apparatus 1.

The outlet defined by the neck 13 formed on the container 11 is designed to form a point of connection for the supply line 8 and return line 10 by way of which the photographic processing chemical 4 is conveyed to and returned from the tank 3 in the processing station 2 of the apparatus 1. For that purpose the supply line 8 and the return line 10 are each provided at their free ends with a respective hollow needle 19,20, such as a hypodermic needle, which is located in a fixed support member 21 forming part of the photographic processing apparatus.

The outlet defined by the neck 15 of the container 11 is designed to serve as a point of connection for a venting arrangement by way of which the interior of the container 11 may be connected to atmosphere. The venting arrangement comprises a vent tube or the like 22 located on the processing apparatus 1, one end of the vent tube 22 carrying a hollow needle 23, such as a hypodermic needle. The needle 23 is supported in the support member 21 which also supports the needles 19,20 connected to the supply and return lines 8,10.

The needle 23 of the venting arrangement and the needles 19,20 by way of which the processing chemical is supplied to and returned from the processing tank 3 are arranged at predetermined positions with respect to each other in the support member 21 so that their positions correspond to the positions of the outlets defined by the necks formed on the end of the container 11.

Figure 3:
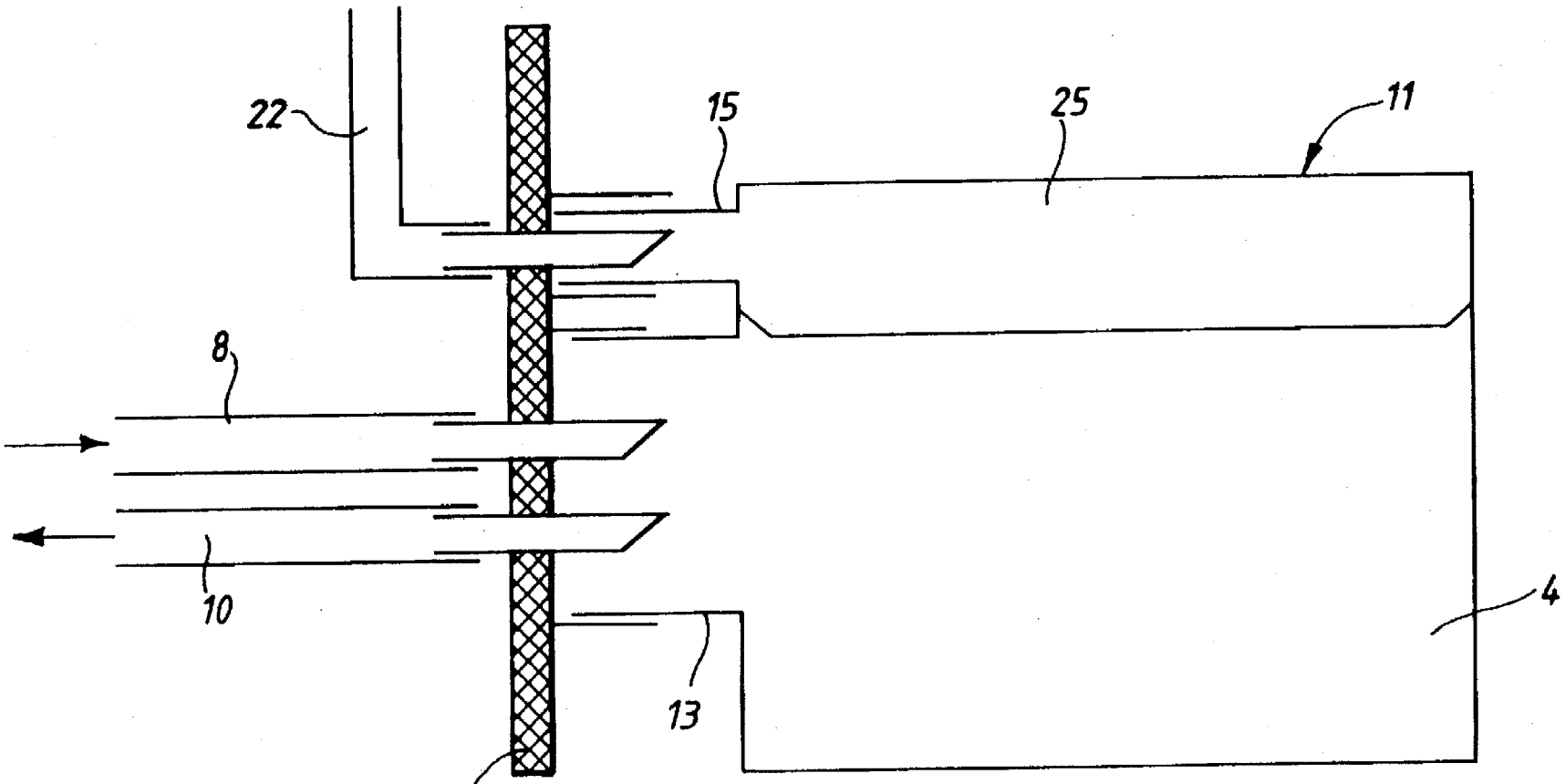
FIG. 3 is a view corresponding to FIG. 2 but illustrating the cartridge when it is connected to the processing apparatus.

When the processing chemical 4 within the container 11 is to be used in the processing apparatus 1, the container is mounted upon the apparatus by pushing the container onto the needles 19,20,23 in the direction of the arrow 24 in FIG. 2 so that the needles pass through the septa 17,18 and the container is in the position as shown in FIG. 3 (or as shown in FIG. 1 for the slightly different design of the container). It will be appreciated that the needles are automatically aligned with the outlets defined by the necks 13,15 by virtue of the fact that they are held in fixed positions by the support member 21 of the processing apparatus. The needles therefore pass through the septa 17,18 which form a seal around the needles.

It will be appreciated that the container is oriented so that the connection with the venting arrangement, as defined by the outlet 16 of the neck 15, is located uppermost so that when the container is mounted upon the processing apparatus the needle 23 of the venting arrangement extends into an air space 25 within an uppermost region of the interior of the container 11.

The processing chemical 4 is pumped into the tank 3 of the processing apparatus by the pump 9 and returns to the container 11 by way of the return line 10 which acts as an overflow from the tank 3.

When the processing chemical is exhausted the pump 9 returns all of the processing chemical to the container 11 and is switched off and the container 11 can then be removed from the processing apparatus by simply pulling it away from the apparatus so that the needles 19,20 and 23 are withdrawn through the septa 17,18. The septa automatically close up on withdrawal of the needles so that the container 11 containing the spent processing chemical 4 is automatically sealed and can be safely transported for disposal or recycling.

It will be appreciated that when the container 11 is connected to the processing apparatus the interior of the container is connected to atmosphere via the venting arrangement comprising the tube 22 and needle 23. Thus, as processing chemical 4 is initially withdrawn from the container 11, no partial vacuum will be created within the interior of the container which would otherwise impose an increased load on the pump 9. Similarly, as processing chemical is returned to the container, air can escape from within the container to atmosphere via the needle 23 and tube 22 so as to prevent a build-up of pressure within the container. This arrangement facilitates the return of all of the processing chemical from the processing apparatus 1 to the container 11 so that no spent chemical is left in the apparatus.

Providing the point of connection for the venting arrangement at the same end of the container 11 as the connection for the supply and return lines by way of which processing chemical is transferred to and from the processing apparatus enables the simultaneous connections with the venting arrangement and the supply and return lines to be established so that there is no need for a manual intervention in order to provide a venting function. The use of a self-sealing cover or septum 18 and the hollow needle 23 to establish the venting connection ensures that the container 11 is always sealed and therefore minimizes any risk of a leakage of processing chemical.

The arrangement shown in the accompanying drawings has a separate supply line and return line for conveying the processing chemical between the container 11 and the tank 3 of the processing station 2 and this arrangement is intended to permit the circulation of processing chemical when the apparatus is in use. It will be appreciated that with such an arrangement the level of the processing chemical within the container 11 does not drop to the same level as when the contents of the container are transferred to the processing tank 3 for use in a "static mode" and are subsequently returned to the container when spent. With this latter arrangement there need only be a single line connecting the processing tank 3 to the container 11 with the processing chemical being supplied to the tank along that line and returned to the container along the same line. With such an arrangement it would, however, be necessary for the connection defined by the neck 13 to be located adjacent the lowermost edge of the container 11, in the manner as shown in FIG. 1 because the level of the processing chemical 4 will drop by a greater distance than when the processing chemical is being circulated between the tank 3 and the container 11. With an arrangement where the chemical is circulated, however, the connection formed by the neck 13 may be located at an elevated position on the end of the container 11 such as is shown in FIGS. 2 and 3.

In a modified arrangement the connections for the supply and return lines and for the venting arrangement may be formed integrally with each other, that is to say there may be a single septum extending across one end of the container 11 with the needles for the supply and return lines and for the venting arrangement passing through one and the same septum. The only limitation is that the needle 23 of the venting arrangement should, in use, extend into an upper region of the interior of the container 11 where there will be an air space above the surface of the processing chemical 4.

Whilst the description above and the accompanying drawings shown an arrangement in which connections are made with the container 11 by way of needles passing through septa, it is to be appreciated that the supply and return lines and the venting arrangement may be connected to the container in other ways, but the arrangement described above is preferred because it lends itself conveniently to an automated system where no manual intervention is necessary other than to position the container 11 upon the processing apparatus and to remove it therefore once the processing chemical is spent.

Where needles and septa are used, however, it should be noted that the needles need not necessarily be sharp. The septa could be pre-pierced upon production with the pierced site automatically closing as a result of the inherent properties of the material fro which the septa are formed. The needles 19,20 and 23 could then take the form of round-nosed, hollow needles which are closed at their free ends but which have a hole extending into their hollow interior from one side at a position displaced from the free end of the needle. These needles can then penetrate the septa at the pre-pierced sites.

As mentioned above, the photographic processing apparatus 1 will have a number of processing tanks to receive different processing chemicals. Each tank will be connected to a respective container of processing chemical. A plurality of containers 11 containing the different chemicals may be received within a single holder or cassette such that they are held at predetermined positions relative to each other. The needles 19,20 and 23 provided at each processing station in the apparatus 1 would be similarly positioned relative to each other so that the single cassette or housing can be mounted upon the processing apparatus in one operation which automatically establishes connections with the supply and return lines and the venting arrangements at each processing station.

PARTS LIST

1 . . . photographic processing apparatus
2 . . . processing station
3 . . . tank
4 . . . photographic processing solution
5 . . . web of photographic material
6,7, . . . sets of rollers
8,10 . . . supply line
9 . . . pump
11 . . . container
12 . . . main body
13,15 . . . projecting neck
14,16 . . . outlet opening
17,18 . . . septum

19,20,23 . . . hollow needle
21 . . . support member
22 . . . vent tube
24 . . . arrow
25 . . . air space

We claim:

1. A cartridge for receiving a photographic processing chemical, the cartridge comprising a main body formed with an outlet through which a chemical may be introduced into or removed from the cartridge and a connection for a venting arrangement to provide communication between the interior of the main body of the cartridge and atmosphere when the cartridge is in use, said connection for the venting arrangement and the outlet are each provided with a closure in the form of a penetrable, self-sealing cover, said outlet being designed to be positioned below the level of the chemical when the container is positioned for use, and said connection for venting arrangement being positioned to allow access to air space formed in the cartridge above said chemical, the outlet and connection for venting arrangement being disposed at one end of said cartridge and being disposed adjacent and facing the same direction.

2. A cartridge according to claim 1, wherein the connection for the venting arrangement and the outlet on the main body each take the form of a projecting neck formed at one end of the main body.

3. A cartridge according to claim 1, wherein the connection for the venting arrangement is formed integrally with the outlet in the main body at one end of the main body.

4. A cartridge according to claim 1, wherein the connection for the venting arrangement and the outlet in the main body are both formed at one end of the main body and are positioned such that when the cartridge is in use the connection for the venting arrangement is disposed uppermost and extends into an upper region of the main body and the outlet is disposed at a lower position.

5. A cartridge according to claim 4, wherein, in use, the outlet is disposed adjacent a lowermost edge of the main body of the cartridge.

6. A photographic processing apparatus comprising at least one tank for receiving a photographic processing chemical and a supply system for supplying the chemical to the tank from a cartridge and for returning the chemical to the cartridge, the apparatus additionally comprising a venting arrangement adapted, when in use, to be connected to the interior of the cartridge by way of a connection for the venting arrangement provided in the cartridge.

7. A photographic processing apparatus according to claim 6, wherein the venting arrangement comprises a hollow needle connected to a venting tube, the needle being adapted, when in use, to extend into the interior of the cartridge through a penetrable self-sealing cover provided on the connection for a venting arrangement.

8. A photographic processing apparatus according to claim 6, wherein the apparatus includes a plurality of tanks for receiving different photographic processing chemicals and a plurality of supply systems, there being a supply system associated with each processing tank and a venting arrangement associated with each supply system, the venting arrangement of each supply system being connected to a respective container of processing chemical when the apparatus is in use.

9. A method of supplying a photographic processing chemical to a photographic processor using a cartridge comprising a main body formed with an outlet through which a chemical may be introduced into or removed from the cartridge and a connection for a venting arrangement to provide communication between the interior of the main body of the cartridge and atmosphere when the cartridge is in use, said connection for the venting arrangement and the outlet are each provided with a closure in the form of a penetrable, self-sealing cover, said outlet being designed to be positioned below the level of the chemical when the container is positioned for use, and said connection for venting arrangement being positioned to allow access to air space formed in the cartridge above said chemical, the outlet and connection for venting arrangement being disposed at one end of said cartridge and being disposed adjacent and facing the same direction, the method comprising the step of mounting said cartridge upon the apparatus and connecting the venting arrangement of the apparatus to the interior of the cartridge by moving the container in a single direction.

* * * * *